US009257762B1

(12) United States Patent
Hsia

(10) Patent No.: US 9,257,762 B1
(45) Date of Patent: Feb. 9, 2016

(54) CABLE CONNECTOR FOR COVERING A CABLE

(71) Applicant: Yu-Chao Hsia, Taipei (TW)

(72) Inventor: Yu-Chao Hsia, Taipei (TW)

( * ) Notice: Subject to any disclaimer, the term of this patent is extended or adjusted under 35 U.S.C. 154(b) by 0 days.

(21) Appl. No.: 14/608,251

(22) Filed: Jan. 29, 2015

(51) Int. Cl.
*H01R 9/05* (2006.01)
*H01R 11/28* (2006.01)
*H01R 13/62* (2006.01)
*H01R 13/58* (2006.01)

(52) U.S. Cl.
CPC ..... *H01R 11/28* (2013.01); *H01R 13/5816* (2013.01); *H01R 13/62* (2013.01); *H01R 9/0521* (2013.01)

(58) Field of Classification Search
USPC ..... 439/439–441, 584
See application file for complete search history.

(56) References Cited

U.S. PATENT DOCUMENTS 5,529,522 A * 6/1996 Huang ..... H01R 9/0527 439/440
6,776,657 B1 * 8/2004 Hung ..... H01R 9/05 439/439
6,910,919 B1 * 6/2005 Hung ..... H01R 9/0527 439/578
7,288,002 B2 * 10/2007 Rodrigues ..... H01R 13/5816 439/439
2006/0252309 A1 * 11/2006 Kodama ..... H01R 13/5808 439/578
2013/0337683 A1 * 12/2013 Chastain ..... H01R 13/5202 439/578

* cited by examiner

*Primary Examiner* — Tho D Ta

(57) ABSTRACT

A cable connector having an outer tube, a first inner tube, a metal ring, a second inner tube and a grip portion is provided. The outer tube has an upper receiving space and a lower receiving space. The first inner tube is disposed in the upper receiving space from up to down. The metal ring is utilized for covering the first inner tube. The second inner tube is disposed in the lower receiving space from down to up. The grip portion is disposed between the outer tube and the first inner tube.

4 Claims, 4 Drawing Sheets

CABLE CONNECTOR FOR COVERING A CABLE

CROSS-REFERENCES TO RELATED APPLICATIONS

Not applicable.

BACKGROUND OF THE INVENTION

1. Field of the Invention

The present invention relates to a cable connector, and more particularly, to a cable connector having a grip portion.

2. Description of the Related Art

In the related art, when insert a cable into a cable connector, it will require additional tools to make the cable connector clamp the cable. As a result, there is a lot of inconvenience when using the cable connector.

In view of this, it is important to provide a cable connector which can be fastening the cable simultaneously while the cable is inserted into the cable connector.

SUMMARY OF THE INVENTION

An objective of the present invention is to provide a cable connector that can be utilized in variety of cables. The cable connector can fasten the cable via a single crimping step when the cable is inserted into the cable connector. Thus, this could save the processing steps and improve operational efficiency.

Another objective of the present invention is to provide a cable connector that without the prior art central tube, and thus the cable can be inserted into the cable connector directly and reduce the obstacles when threading the cable.

To achieve the aforesaid objective, a cable connector having an outer tube, a first inner tube, a metal ring, a second inner tube and a grip portion is provided. The outer tube has an upper receiving space and a lower receiving space. The first inner tube is disposed in the upper receiving space from up to down. The metal ring is utilized for covering the first inner tube. The second inner tube is disposed in the lower receiving space from down to up. The grip portion is disposed between the outer tube and the first inner tube.

To achieve the aforesaid objective, in this invention, the grip portion is an annular grip portion.

To achieve the aforesaid objective, in this invention, the cable is inserted into the second inner tube, the grip portion and the first inner tube in sequence, and the cable is exposed in the metal ring portion.

To achieve the aforesaid objective, in this invention, the outer tube further has a projection to distinguish the upper receiving space and the lower receiving space.

To achieve the aforesaid objective, in this invention, the material of the second inner tube is fiber reinforced plastics.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

Figure 1:
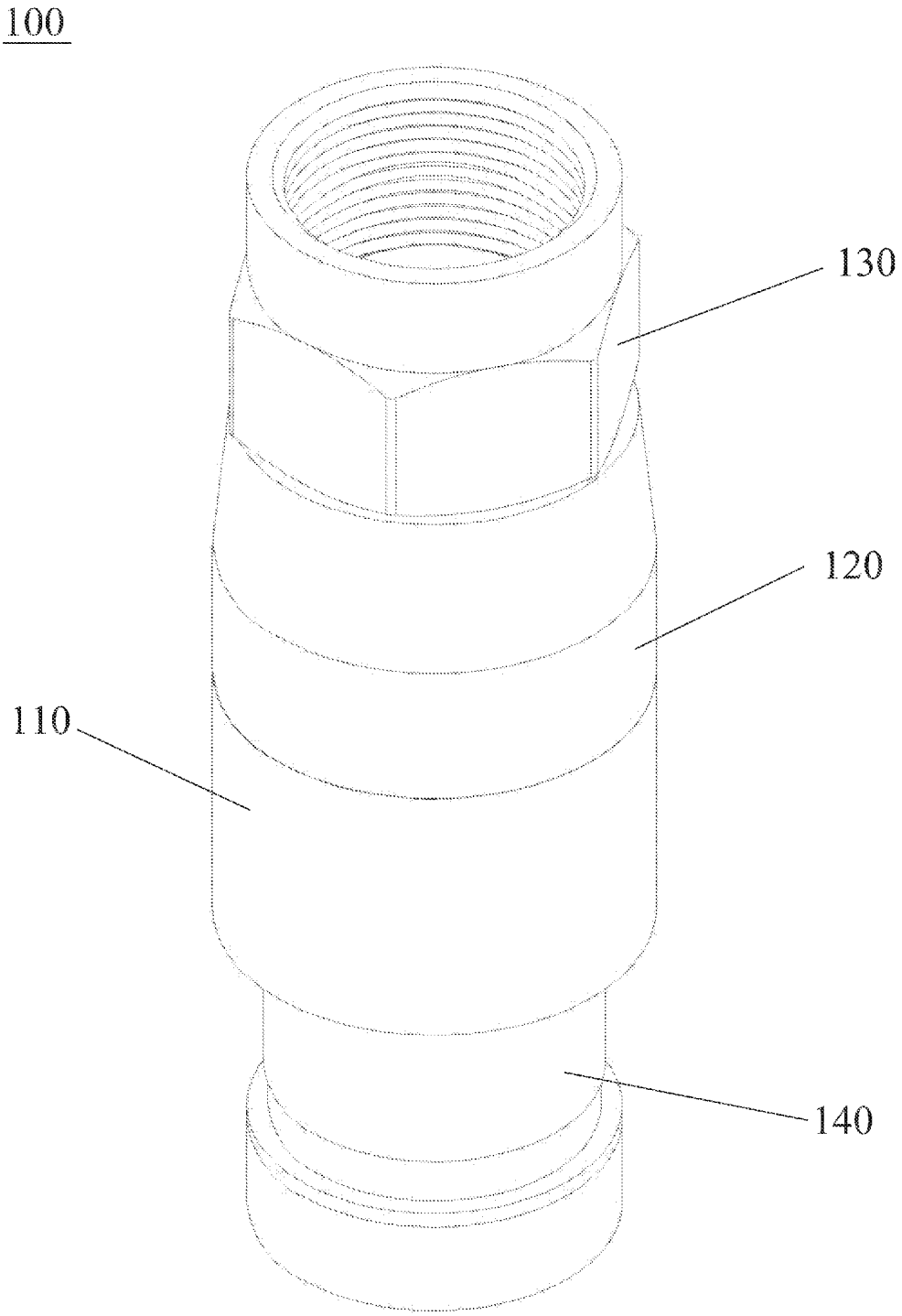
FIG. 1 is a schematic view of a cable connector according to the present invention.
Figure 2:
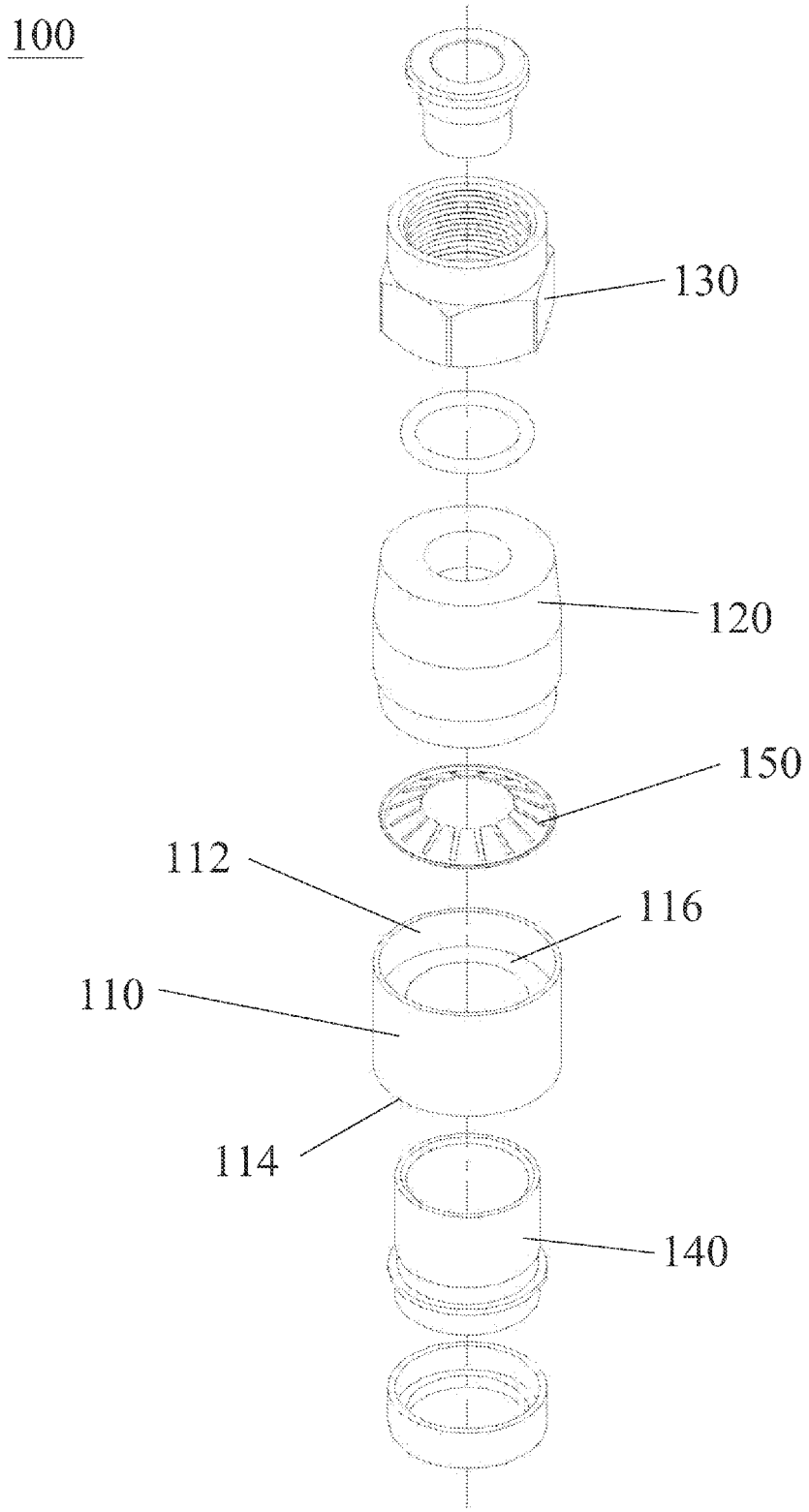
FIG. 2 is an exploded view of the cable connector according to the present invention.
Figure 4:
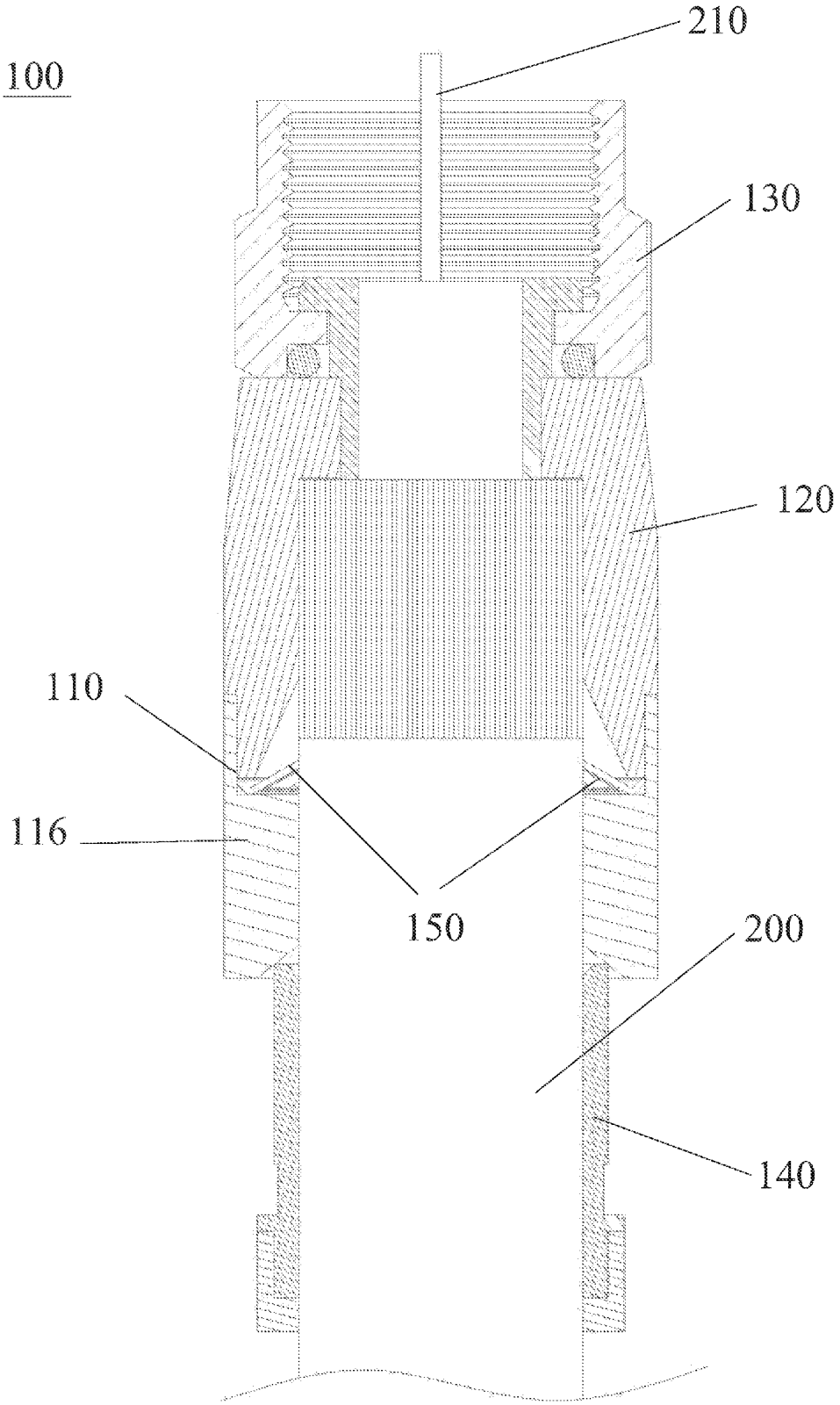
FIG. 4 is another cross-sectional view of the cable connector according to the present invention.

With reference to FIGS. 1 and 2, a cable connector 100 of the present invention is utilized for covering a cable 200 (as shown in FIG. 4). More specifically, the cable 200 is inserted into the cable connector 100.

Figure 3:
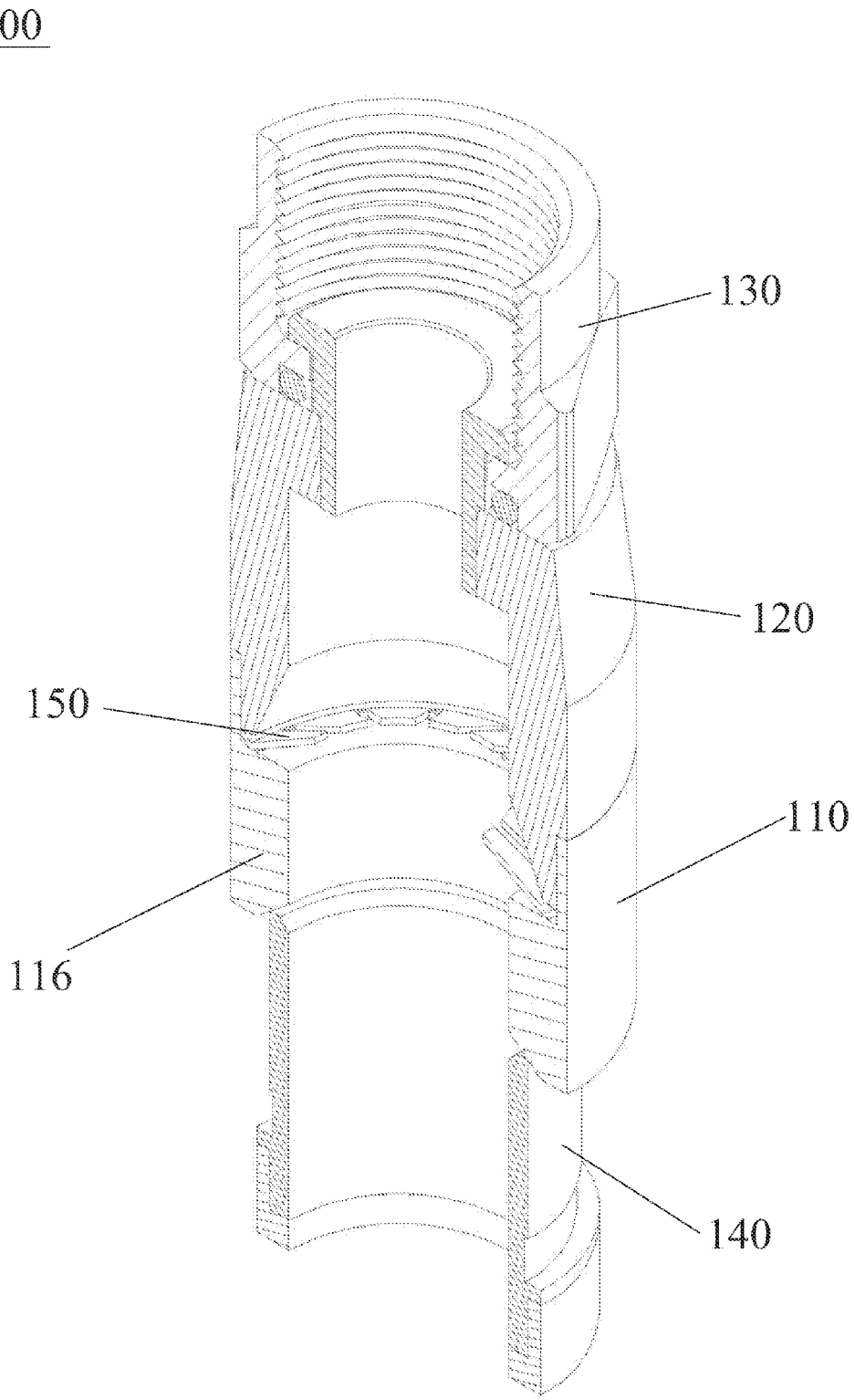
FIG. 3 is a cross-sectional view of the cable connector according to the present invention.

As shown in FIG. 2, the cable connector 100 of the present invention has an outer tube 110, a first inner tube 120, a metal ring 130, a second inner tube 140 and a grip portion 150. With reference to FIGS. 3 and 4, the outer tube 110 has an upper receiving space 112 and a lower receiving space 114, and the first inner tube 120 is disposed in the upper receiving space 112 from up to down. The metal ring 130 is utilized for covering the first inner tube 120 opposite the other side of the upper receiving space 112. On the other hand, the second inner tube 140 is disposed in the lower receiving space 114 from down to up. Meanwhile, the grip portion 150 is disposed between the outer tube 110 and the first inner tube 120.

In one preferred embodiment of the present invention, the grip portion 150 of the cable connector 100 is an annular grip portion. As a result, as shown in FIG. 4, when the cable 200 is inserted into the second inner tube 140, the grip portion 150 and the first inner tube 120 in sequence from down to top, the cable 200 is thus exposed in the metal ring 130. In addition, since the grip portion 150 (i.e. the annular grip portion) grips the annular portion of the cable 200 at the same time, the cable connector 100 of the present invention is thus have the fasten effect to the cable 200. Thus, the cable connector 100 of the present invention can avoid the additional tools and the complicated steps for fastening the cable.

Besides, the outer tube 110 of the cable connector 100 of the present invention further has a projection 116 to distinguish the upper receiving space 112 and the lower receiving space 114, and the projection 116 is utilized to hold the grip portion 150.

Since the material of the second inner tube 140 is fiber reinforced plastics, after the cable 200 is inserted into the cable connector 100, the cable connector 100 is fastened in the cable 200 via crimping the second inner tube 140 disposed into the lower receiving space 114 with a single crimping step by the tool. Therefore, the cable connector 100 of the present invention can have both waterproof and tensile effect.

As mentioned above, since the grip portion 150 of the cable connector 100 of the present invention can fasten the cable 200 via a single crimping step when cover the cable 200, the cable connector 100 is more effective to save process steps with respect to the prior art. In addition, since the cable connector 100 of the present invention has no prior art central tube, the cable 200 can be inserted into the cable connector 100 directly, and thus reduce the obstacles and accelerate the operation efficiency.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A cable connector for covering a cable, comprising:

an outer tube, having an upper receiving space and a lower receiving space;

a first inner tube, being disposed in the upper receiving space from up to down;

a metal ring, being utilized for covering the first inner tube;

a second inner tube, being disposed in the lower receiving space from down to up; and a grip portion, being disposed between the outer tube and the first inner tube;

wherein the outer tube further has a projection to distinguish the upper receiving space and the lower receiving space.

2. The cable connector as claimed in claim 1, wherein the grip portion is an annular grip portion.

3. The cable connector as claimed in claim 1, wherein the cable is inserted into the second inner tube, the grip portion and the first inner tube in sequence, and is exposed in the metal ring.

4. The cable connector as claimed in claim 1, wherein the material of the second inner tube is fiber reinforced plastics.

* * * * *